United States Patent [19]

Sable

[11] 3,988,988

[45] Nov. 2, 1976

[54] DEVICE FOR DRYING THE SURFACE OF A BLANKET CYLINDER OF INK WASHING SOLVENT

[75] Inventor: Harvey James Sable, Cleveland, Ohio

[73] Assignee: Addressograph Multigraph Corporation, Cleveland, Ohio

[22] Filed: Apr. 21, 1975

[21] Appl. No.: 570,222

[52] U.S. Cl. ..... 101/425; 101/169; 101/365

[51] Int. Cl.[2] ..... B41L 41/00; B41F 35/00; B41F 9/08

[58] Field of Search..... 101/167, 169, 425, 416 R, 101/365, 367; 137/123, 142, 144, 147; 15/256.5, 256.51; 222/204; 100/112

[56] References Cited

UNITED STATES PATENTS

| | | | |
|---|---|---|---|
| 2,899,754 | 8/1959 | Adams et al. | 15/256.5 X |
| 2,936,073 | 5/1960 | Thompson | 15/256.51 X |
| 3,120,802 | 2/1964 | Smejda | 101/169 X |
| 3,640,302 | 2/1972 | Willinger | 137/142 |
| 3,656,431 | 4/1972 | Giori | 101/169 X |
| 3,683,445 | 8/1972 | Hagadorn | 15/256.5 X |
| 3,750,691 | 8/1973 | Lidolph | 137/142 |
| 3,778,861 | 12/1973 | Goodnow | 15/256.51 |
| 3,783,781 | 1/1974 | Grommek | 101/169 X |
| 3,822,642 | 7/1974 | Grindeland | 101/169 X |
| 3,829,927 | 8/1974 | Boyland | 15/256.51 X |
| 3,835,779 | 9/1974 | Ross et al. | 101/425 |
| 3,896,730 | 7/1975 | Garrett | 101/425 |

*Primary Examiner*—Edgar S. Burr
*Assistant Examiner*—Paul J. Hirsch
*Attorney, Agent, or Firm*—Sol L. Goldstein

[57] ABSTRACT

A device for removing the solvent wash liquid that is applied to a lithographic blanket for the purpose of removing the residual ink image constructed of a pair of flat plates, separated from one another by a narrow height in the range of 0.005 inches to 0.06 inches, and which provides a capillary channel between the two plates for collecting liquid. The front edge of the lower plate is formed into a wiping edge which makes contact with the full width of the blanket and acts as a wiper blade for accumulating liquid at the entryway of the channel. Any liquid presented to the capillary channel immediately fills the channel and excess liquid flows out the back end of the channel by force of gravity into a collecting vessel. Optionally, a negative pressure pulse of short duration may be applied to the channel in order to assist in the rapid removal of any accumulated liquid within.

6 Claims, 5 Drawing Figures

DEVICE FOR DRYING THE SURFACE OF A BLANKET CYLINDER OF INK WASHING SOLVENT

BACKGROUND OF THE INVENTION

This invention deals with removal of the washing solvent from an offset blanket after it has been washed with solvent to remove the ink image and, more particularly, with a device capable of collecting and conducting away either through capillary action or capillary action and the force of gravity, the small quantity of liquid left behind as a result of the washing operation.

The process of lithographic duplicating usually involves the use of a resilient rubber blanket to which is transferred the ink image created on the master and which is ultimately transferred to impression paper. Such a blanket is generally referred to in this art as an offset blanket.

In the typical construction of a lithograhic duplicator, the printing instrumentalities are mounted on a series of cylinders which give rise to a master cylinder on which is carried the lithographic master, a blanket cylinder on which is carried the resilient offset blanket, the impression cylinder which merely serves to help transfer the ink image from the blanket to the impression paper.

At the end of a duplicating cycle, it is necessary to remove the residual ink image by cleaning the blanket, in preparation for the next duplicating cycle.

The number of techniques and devices which are disclosed and described in the prior art are numerous in terms of applying a suitable solvent for washing away the ink thereby cleaning the blanket. A wide variety of techniques for cleaning the blanket are known, including the use of sponges and applicators which turn both concurrent and countercurrent to the blanket cylinder; some of which include power driven scrubbers and the like. All are calculated to effectively apply the solvent to the ink layer to wash it away from the surface. Inevitably, there remains on the blanket surface, a thin layer of solvent which must be removed and the blanket surface appropriately dried in advance of the next duplicating cycle. If the blanket is not appropriately dried, copies of inferior lithographic quality will result.

The chemical composition of such solvents has been formulated to satisfy a number of requirements imposed by the duplicating system. They must, of course, have appropriate solvency for the ink but at the same time have sufficiently high flash points to avoid a fire hazard. Toxicity is an important factor. Materials having the appropriate degree of solvency for the ink but a high toxic hazard cannot be used. Methods which depend on evaporation cannot deal effectively with the conflicting requirements of rapid removal and low air contamination level. Since this apparatus accumulates and removes the excess wash solvent quickly and in liquid form, the problem of toxicity is virtually eliminated and the selection of a suitable solvent far simpler.

It is desirable in the operation of a lithograhic duplicating machine to complete each of the operations as quickly as possible in order to proceed with the productive printing operations. This is especially true of a highly automated lithographic duplicator which may be used for printing only five or six copies of each master. Under these circumstances, cleaning and drying the blanket takes nearly as long as printing the copies.

It is a general object of the present invention to provide an improved device for rapidly removing solvent from the offset blanket remaining from the ink washing operation quickly and effectively in a very short period of time.

It is a further object of the present invention to provide a device for quickly and effectively removing all necessary solvent remaining on the blanket without the use of special devices that cause the material to evaporate into the working environment or the use of suction devices that operate with large volumes of air being passed through the system.

It is a still further object of the present invention to provide a highly effective and simply constructed, easy to operate device for removing sufficient solvent remaining from the ink washing operation of the blanket by means of a wiper which collects the solvent liquid and directs the liquid into a capillary channel for removal to a waste collecting reservoir.

It is a specific object of this invention to provide a highly effective solvent removal device that collects the fluid and conducts it away without the need for using large volumes of air induced by high vacuum, heat or other procedures that cause the evaporation of the solvent into the atmosphere and can dry the blanket in one or two revolutions of the blanket cylinder.

SUMMARY OF THE INVENTION

As is conventional with lithographic duplicating devices, there is provided a blanket cleaning device which washes the ink from the blanket surface. Such a blanket cleaning device is automatically operated as one of the operating cycles in an automatically programmed control for such highly productive duplicators. Included in the cleaning operation, there must of necessity be a drying operation for the purpose of removing the excess solvent remaining on the surface of the blanket after all of the ink has been removed.

Such a solvent removal device is provided herein comprising a liquid collector which extends transverse to the direction of rotation of the blanket cylinder and is co-extensive the width of the blanket. The collector includes a capillary channel with an entryway adjacent the surface of the blanket into which is received the excess solvent or other liquid that has been applied to the blanket surface. Included in the construction of the liquid collecting device is a wiping blade adjacent the entryway to the capillary channel which serves to accumulate the liquid at the entryway which fills the channel. The waste liquid is collected at an exit from the channel into a reservoir.

The liquid collector is capable of removing all of the liquid left on the blanket surface routinely in very few rotations of the blanket cylinder. In normal operation a single pass will dry the blanket.

DETAILED DESCRIPTION

Figure 1:
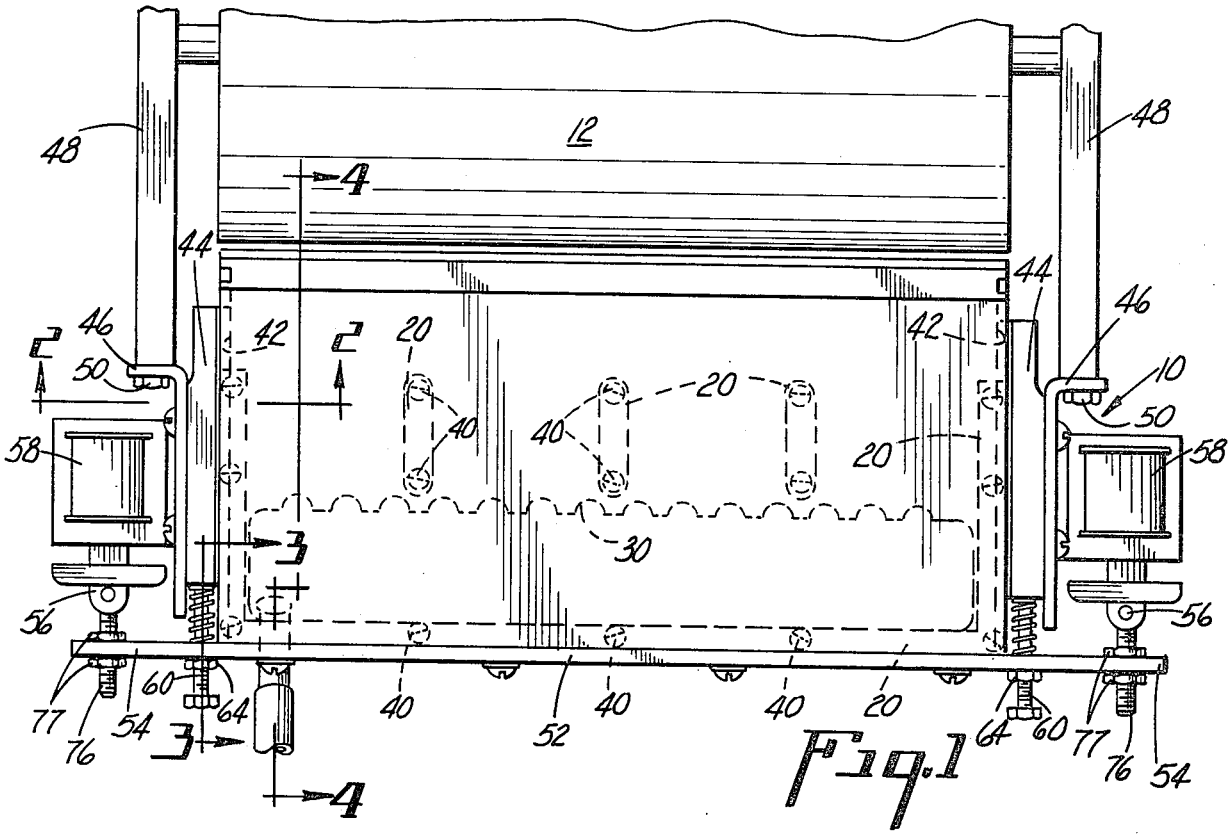
FIG. 1 is a plan view of the liquid collector adjacent the blanket cylinder.
Figure 5:
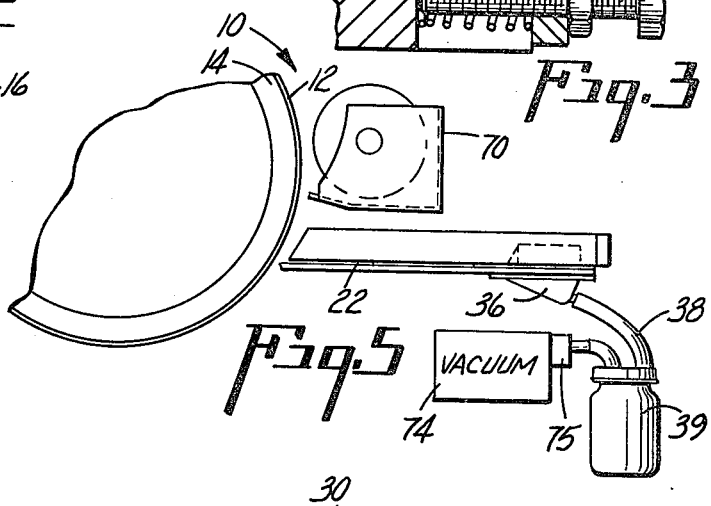
FIG. 5 is a schematic representation of the collecting device in the non-operating position against the blanket and its positional relationship to the ink washing system.
Figure 4:
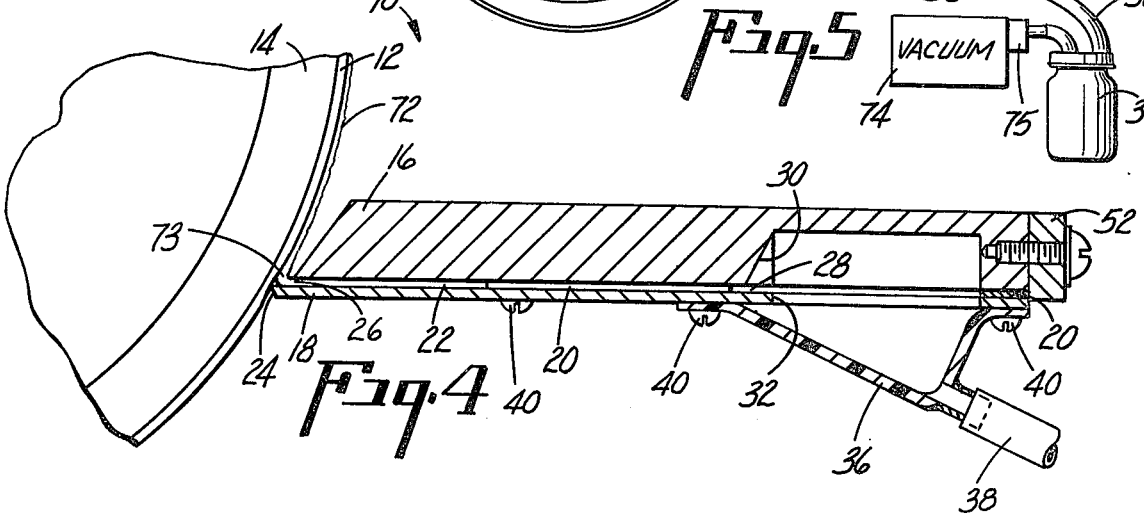
FIG. 4 is a sectional view taken along line 4—4 of FIG. 1 showing the collection device in operation against the blanket surface.

Referring to FIGS. 1, 4 and 5 of the drawings, there is shown the solvent collecting device identified generally with the reference numeral 10 disposed adjacent the surface of the rubber blanket 12 which completely covers the blanket cylinder 14. The solvent collecting device 10 (FIG. 4) is formed by a pair of plate members, an upper plate 16 and a lower plate 18, which are maintained in spaced apart relationship from one another by spacers 20 formed of a narrow thickness of metal shim stock which is positioned around the edge boundaries of the plates, and internally located as shown in FIG. 1. As shown in FIGS. 4 and 5, with the plates in spaced apart relation, there is formed a channel 22 equivalent to the volume enclosed by the upper plate 16 and the lower plate 18 and separated by a distance equal to the thickness of the spacers 20.

The leading edge of the lower plate 18 (FIG. 4) has a fine edge 24 which protrudes beyond the front edge of the upper plate 16. The lateral opening at the front end of the channel formed between the front edges of the plates 18 and 16 forms an entryway 26 into the channel through which fluid enters along the full width of the blanket 12. Toward the rear of the collecting device, there is provided an exitway 28 formed by the contoured cut-out 30 (FIG. 1) cut in the roof of the upper plate 16 which is superimposed over and coincides with the longitudinal slot 32 cut in the lower plate 18. A liquid collecting well 36 encloses the longitudinal slot 32 into which flows the liquid passing into the entryway 26 of the channel 22 and out of the exitway 28. It is collected in the lower portion of the well 36 and thence to a waste collector through the drain 38.

The formation of the liquid collecting well 36 and exitway 28 as shown in FIG. 1 provides an irregular or scalloped edge 30. It is believed that such an irregular edge permits the body of liquid to flow into the well 36 uniformly along the full extent of the exitway as opposed to selectively flowing through one particular section along the exitway. The precise formation is not critical only as long as it is irregular. However, it is expected that a straight edge would perform to equal advantage.

It will be appreciated that the height of the channel 22 corresponds to the thickness of the spacers 20 which is in the range of 0.005 inches to 0.06 inches. The height of the channel 22 is important to the successful operation of the solvent drying invention for the reason that it depends on the force of capillary action to move the liquid into the entryway 26 and fill the cavity 22. A more detailed explanation of the operation of the channel 22 will be explained in greater detail hereinafter.

Figure 2:
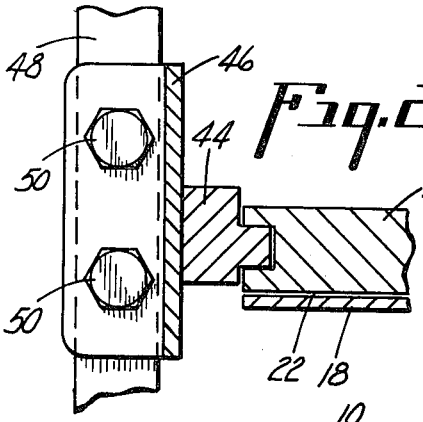
FIG. 2 is an enlarged partial section of the slidable mounting of the device taken along line 2—2 of FIG. 1.
Figure 3:
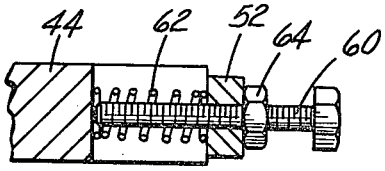
FIG. 3 is an enlarged detail in partial section taken along line 3—3 of FIG. 4.

The plates 16 and 18 are fastened together by a series of threaded fasteners 40 which extend along the lateral edges of the plates, passing through the spacers 20 as well as the liquid well 36, thereby holding together the entire assembly. The upper plate 16 has a U-shaped groove 42 cut along each of its lateral edges (FIG. 2) into which is matingly engaged the slide bars 44. The slide bars 44 are attached toa pair of brackets 46 which, in turn, are affixed to the side frames 48 of the duplicator by suitable threaded fasteners 50 (FIGS. 1 and 2).

Extending laterally across the back side of the upper plate 16 (FIG. 1) is a control bar 52 which extends beyond the width of the blanket providing extension arms 54 to which are affixed the plunger element 56 of a conventional solenoid 58. The solenoids are maintained in the stationary position on the frame of the duplicator.

In operation, a blanket wash device 70 (FIG. 5) will apply solvent to the blanket 12 for a number of washing cycles until all of the ink deposited on the surface is removed. The washing cycles occur at the end of a printing operation and in advance of the next printing operation. This leaves a layer of solvent 72 on the surface of the blanket 12 (FIG. 4) which must be dried or removed before further printing can occur. If this solvent layer is not removed, the print optical density of at least three or four subsequent printed images will be unacceptably low. Where one is interested in printing only five or six copies per master, it becomes important to have an acceptable first copy.

As shown in FIG. 4, the blade 24 is brought into wiping contact by energizing the solenoid 58 which pulls in the plunger 56 urging the lower plate 18 into contact with blanket 12.

The amount and uniformity of pressure between the edge 24 of the lower plate 18 and the blanket 12 is controlled by the position of the threaded screws 76 in control bar 52. This adjustment is maintained by tightening locknuts 77 on threaded screws 76 against the control bar 52.

When solenoids 58 are energized, the control bar 52 moves toward the blanket cylinder 14 until the solenoid armatures 56 seat against the solenoids 58. This establishes the distance between the blanket 12 and the edge 24 of the lower plate 18 to move into position causing the solvent on the blanket 12 to accumulate on the edge of the lower plate 18 without undue wear to either component. This wiping pressure is directly controlled by this adjustment of solenoid plunger and is the net result of elastic deflection of the blanket 12 and cantilever flexure of the lower plate 18.

Movement of the control bar 52 toward the blanket 12 also compresses coil springs 62 which encircle threaded screws 60 and serve to return the wiper assembly to its starting position when solenoids 58 are de-energized. The function of the threaded screws 60 is to guide the coil springs 62 and to provide stops which establish the maximum distance subsequently controlled by threaded screws 76.

Threaded screws 60 are normally adjusted using a feeler gauge for 0.015 inches of clearance between the edge of the lower plate 18 and the backside of the blanket 12 which provides for about 0.023 inches of interference between these components. A second feeler gauge is then used between the ends of threaded screws 60 and the back of the slides 44 while threaded screw 76 is adjusted to provide for 0.012 inches of clearance with the solenoid armatures 56 seated against the solenoids 58. The interference between the edge of the lower plate 18 and the blanket 12 in operation is $0.023 - 0.012 = 0.011$ inches. The adjustment and control afforded by the threaded stop-solenoid arrangement is simple to carry out and permits very close and accurate pressure adjustments.

The action of the edge of the lower plate 18 against the surface of the blanket 12 causes a bead of solvent 73 to form at the entryway 26 of the channel 22. Through the force of capillary action the liquid rapidly and quickly fills the entire channel 22 from entryway to exitway provided the volume of fluid is equivalent to the volume of the channel. Any excess of fluid, of course, flows out from the exitway and collects in the well 36.

It is important to understand that the movement of liquid between the two plates is similar as to what occurs when one is depositing liquid for microscopic examination between two glass microscope slides. Most people have observed that when a drop of liquid is placed at the edge of a glass slide in contact with another slide, the liquid immediately flows in between the two surfaces and remains in place for any further observation. In the instant invention, the liquid in similar fashion fills the channel 22. As new liquid is accumulated at the entryway 26 by virtue of the wiper rubbing against the blanket 12 and forming a bead of liquid 73 at the entryway, it is forced out of the exitway 28 and flows into the well 36 and out the drain 38 into a waste collection bottle 39.

In order to give a slight assist to the removal of the liquid from the channel 22, a negative pressure might be created inside the well 36 during the drying operation to void the fluid from the channel. The negative pressure may be applied for very short duration, just long enough to cause the fluid to flow out. To accomplish this, the waste bottle 39 may be connected to a source of vacuum 74 through a solenoid valve 75 to create a negative pressure pulse of short duration in the system urging fluid from the channel 22. It is important to understand that the vacuum is not necessary to achieve the drying of the blanket. The vacuum may optionally be utilized only for the purpose of purging liquid from the channel. The purging operation may occur during or after the drying operation is completed. The reference to the drying operation, as used herein, means the action of the blade edge 24 contacting the full width extent of the blanket 12 thereby forming or collecting a bead of liquid 73 at the entryway 26 to the channel 22 so that the liquid immediately fills the channel through to the exitway 28.

The nature of wash solvent will vary greatly as the duplicating operation is carried out. Understandably the layer of solvent removed from the blanket will include the various components of the ink that are soluble in the solvent as well as those components that are dispersed in the ink and insoluble. Further, it will include paper lint. The wash solvent therefore will be a mixture of waste materials and its density will vary from one cleaning operation to the next. Notwithstanding this variable condition of the fluid the channel as described serves to collect the liquid and direct it to the waste bottle under the method of operation as described.

The use of the term "dry" as it is commonly used would lead one to believe that the blanket has the solvent removed by evaporation techniques. Such evaporation techniques may occur through blowing of warm air on the surface or otherwise drawing air into a plenum across the surface of the blanket so as to effect substantial evaporation of the liquid into the atmosphere. The drying by the device described herein is primarily achieved by collecting and removing the liquid with little or no air flowing across the surface to cause evaporation of the solvent. Drying is achieved by liquid removal which is extremely beneficial in that the blanket may be rendered completely dry in one or two revolutions of the blanket without contamination of the ambient atmosphere with solvent fumes as occurs when evaporation techniques are employed in drying the blanket.

Hence, one of the benefits of using this invention results from the fact that evaporation of the solvent is avoided. It is well known that the blanket material is somewhat absorbant and evaporation of the materials from the surface of the blanket invariably leaves a residue within the porous structure of the blanket. Eventually, the accumulation of residue destroys the usefulness of the blanket by altering its ink wetting characteristics. The drying achieved in this invention, in the manner described, as opposed to evaporation, leaves much less residue on the body of the blanket. Further, the wiping action of the blade edge 24 forces liquid from within the porous structure near the surface.

The invention has been described with a great deal of particularity for the purpose of disclosing an embodiment which will provide the necessary capillary action for removing the liquid. What is intended to be covered by United States Letters Patent is defined in the appended claims.

What is claimed is:

1. In a printing machine equipped with a rotatable resilient blanket adapted to carry on its surface a transferrable ink pattern to be transferred to a receiving surface, and including a solvent wash removal means comprising a liquid collector extending transverse the direction of rotation of said blanket cylinder and coextensive the width of said blanket, said collector having a capillary channel formed between upper and lower rigid plates in spaced apart relation to one another so as to form the capillary channel therebetween with an entryway adjacent the blanket surface for removing wash liquid applied to the blanket, wiping means adjacent said entryway for forming a liquid bead at the entryway to said channel, whereupon the liquid bead moves through and occupies said channel by capillary forces;

means for movably mounting and locating said collector in a predetermined wiping relation to said blanket including means for moving said collector into and out of contact with said blanket surface.

2. The apparatus as claimed in claim 1 wherein said liquid collector is slidably mounted on rail means for supporting said collector in the transverse position and bringing it into and out of liquid removing contact with said blanket and drive means for moving said liquid collector.

3. The apparatus as claimed in claim 2 wherein said drive means comprises electromagnetically operated drive elements mechanically linked to said liquid collecting device and employing a coil spring return mechanism.

4. In a printing machine equipped with a rotatable resilient blanket adapted to carry on its surface a transferrable ink pattern to be transferred to a receiving surface and including means for solvent washing the ink pattern from the surface, the improvement comprising solvent wash removal means comprising a closed liquid collecting chamber having an entryway and exitway, said chamber extending substantially coextensive the width of said blanket adapted to receive a volume of liquid therein, and including upper and lower rigid plates in spaced apart relation to one another so as to form a channel therebetween extending between said entryway and exitway, said space between the plates being sufficiently small to collect said liquid and sustain liquid movement therein by capillary forces at atmospheric pressure and a wiper member associated with said lower plate for collecting and removing the liquid from the blanket surface and directing it to said entryway.

5. The apparatus as claimed in claim 4 wherein the space between the plates is in the range of 0.005 inches to 0.06 inches.

6. In a printing machine equipped with a rotatable resilient blanket adapted to carry on its surface a transferrable ink pattern to be transferred to a receiving surface and including solvent wash removal means comprising a closed liquid collecting chamber having an entryway and exitway, said chamber extending substantially coextensive the width of said blanket adapted to receive a volume of liquid therein, and including upper and lower rigid plates in spaced apart relation to one another so as to form a channel therebetween extending between said entryway and exitway, said space between the plates being sufficiently small to collect said liquid and sustain liquid movement therein by capillary forces;

a blade member in wiping contact with the blanket surface for collecting the solvent at said entryway and capillary channel means for directing the collected solvent to a reservoir, vacuum means connected to said capillary channel for momentarily applying a negative pressure thereto when said channel is full, whereby the surface of the blanket is rendered dry.

* * * * *